United States Patent [19]

Bish

[11] 3,963,155

[45] June 15, 1976

[54] DUAL GARMENT HANGERS

[75] Inventor: Austin W. Bish, Sherwood Park, Canada

[73] Assignee: Lawrence Peska Associates, Inc., New York, N.Y. ; a part interest

[22] Filed: Feb. 12, 1975

[21] Appl. No.: 549,345

Related U.S. Application Data

[63] Continuation-in-part of Ser. No. 428,703, Dec. 27, 1975, abandoned.

[52] U.S. Cl. ..... 223/88; 223/98

[51] Int. Cl.[2] ..... A47J 51/094

[58] Field of Search ..... 223/85, 88, 89, 90, 223/91, 92, 93, 94, 98; 211/113, 119

[56] References Cited

UNITED STATES PATENTS

| | | | |
|---|---|---|---|
| 2,070,673 | 2/1937 | Moore | 223/88 |
| 2,083,077 | 6/1937 | Mayer | 223/93 X |
| 2,187,579 | 1/1940 | Knopke | 223/91 |
| 2,677,484 | 5/1954 | Bohl | 223/88 |
| 2,734,638 | 2/1956 | Feldman | 223/88 X |
| 2,910,215 | 10/1959 | Auten | 223/98 |
| 3,029,990 | 4/1962 | Roberts et al. | 223/88 |
| 3,042,275 | 7/1962 | Wendorf | 223/88 |

*Primary Examiner*—George H. Krizmanich
*Attorney, Agent, or Firm*—Richard E. Nanfeldt

[57] ABSTRACT

Two ordinary wire clothes hangers are held together to make one better hanger by two plastic parts, one of which stretches over the two hook ends and the other over the two lower bars.

2 Claims, 5 Drawing Figures

DUAL GARMENT HANGERS

This application is a continuation-in-part of the prior pending application Ser. No. 428,703 filed Dec. 27, 1973, now abandoned.

SUMMARY OF THE INVENTION

The present invention relates to improvements in garment hangers, and more particularly in wire hangers for coats, overcoats, vests and the like which can also be used for trousers, skirts, or similar wearing apparel.

Wire hangers are widely used for supporting all types of garments including coats, overcoats, trousers, dresses, skirts, and the like, but have the disadvantage that they are structurally weak and sag under the weight of the garment. Moreover, trousers which are folded over a cross-piece are creased which is undesirable.

It is a principal object of the invention to provide an improved wire garment hanger which will provide greater support for garments.

It is a further object of the invention to provide a garment hanger which will allow garments to fold over it and hang suspended without forming undesirable creases.

These and further objects of the invention will appear as the specification progresses.

In accordance with the invention, a pair of wire garment hangers are secured together by placing them side-by-side and slipping a tubular member of resilient material, closed at one end, over the hook portions of the hangers. Similarly, a bar-shaped member of resilient material is placed over the horizontally extending lower portions which are designed to support folded garments. Preferably, the tip and sides of the bar-shaped member have a slightly rough finish to prevent slippage of the garment.

BRIEF DESCRIPTION OF THE DRAWINGS

The invention will be described in greater detail with reference to the accompanying drawing, in which.

DESCRIPTION OF THE PREFERRED EMBODIMENT

Figure 1:
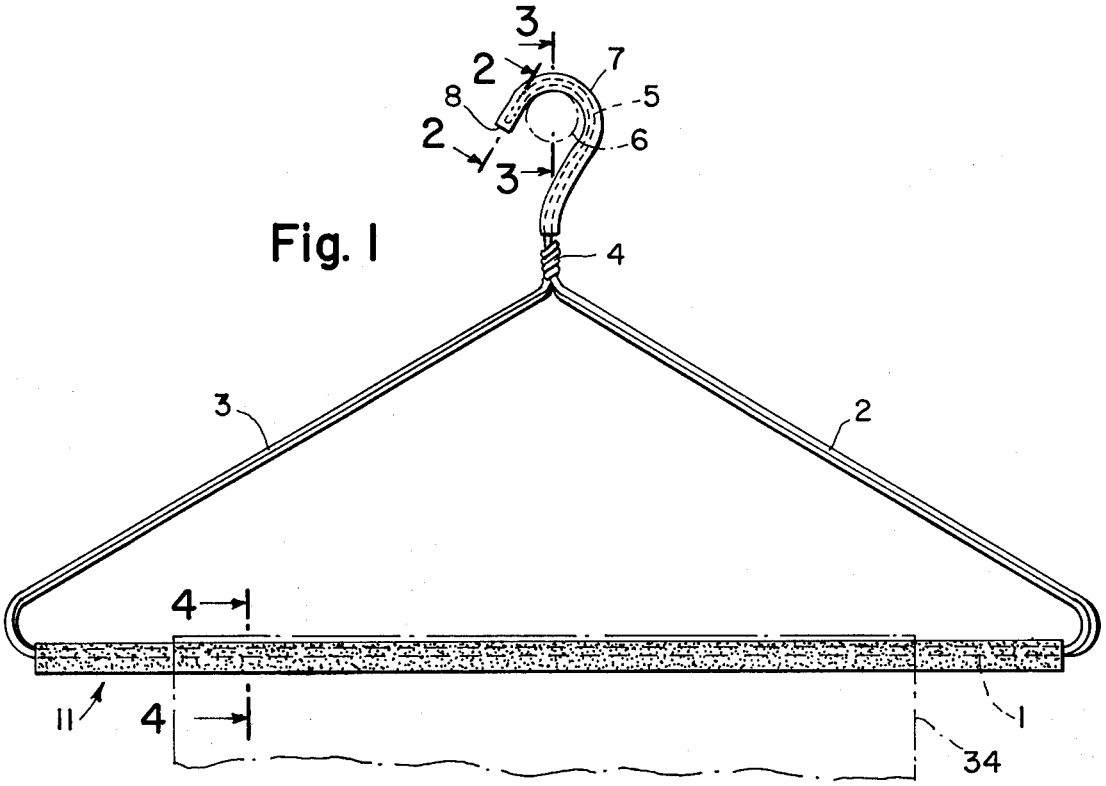
FIG. 1 shows a double wire garment hanger according to the invention.

Turning now descriptively to the drawings, in which similar reference characters denote similar elements throughout the several views;

FIG. 1 shows the configuration of a wire-shaped garment hanger, two being provided, one behind the other. The hanger is wire which has been bent to form a longitudinally extending portion 1 and two inclined portions 2 and 3, the end of one inclined portion being wrapped around a vertically extending portion 4 of the other inclined portion. This vertically-extending portion is then bent into a hook 5 which can fit over a rod 6 for supporting garments.

Figure 2:
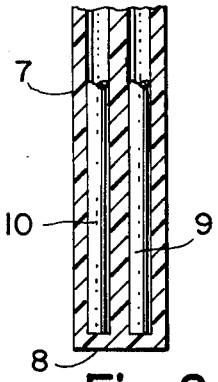
FIG. 2 shows a cross-section along the lines 2—2 of FIG. 1.
Figure 3:
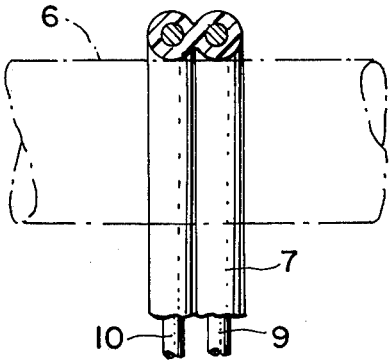
FIG. 3 shows a cross-section along the lines 3—3 of FIG. 1.

Over the hook ends of two such garment hangers, one behind the other in FIG. 1, a rubber plastic sheath 7 shown in greater detail in FIG. 2 is slipped. This plastic sheath 7 is closed at one end 8 and completely encloses each of the wire hooks 9, 10 as shown in FIGS. 2 and 3.

Figure 4:
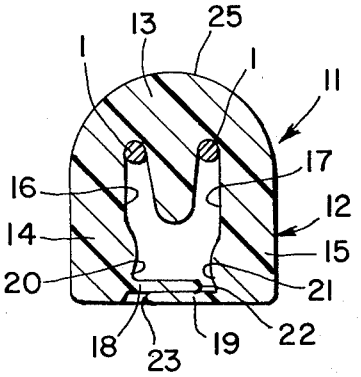
FIG. 4 shows a cross-section along the lines 4—4 of FIG. 1.

FIG. 4 shows a joining member 11 that holds together the longitudinally extending portions 1 of the two wire shaped garment hangers. The joining member 11 comprises an inverted elongated U-shaped member 12 having a top center portion 13 and a pair of downwardly extending legs 14, 15. A pair of parallel elongated groves 16, 17 are contained on the interior surface of the center portion 13 of member 11. Flexible flange members 18, 19 extend perpendicularly inwardly from the interior face 20, 21 of the legs 14, 15, wherein the inner free ends 22, 23 of the flanges overlap each other. The portions 1 are pushed upward through the flange members 18, 19 and secured into the groves 16, 17. The flange members 18, 19 prevent the portions 1 from slipping out of the joining member 11, if the portions 1 become disengaged from the groves 16, 17.

Figure 5:
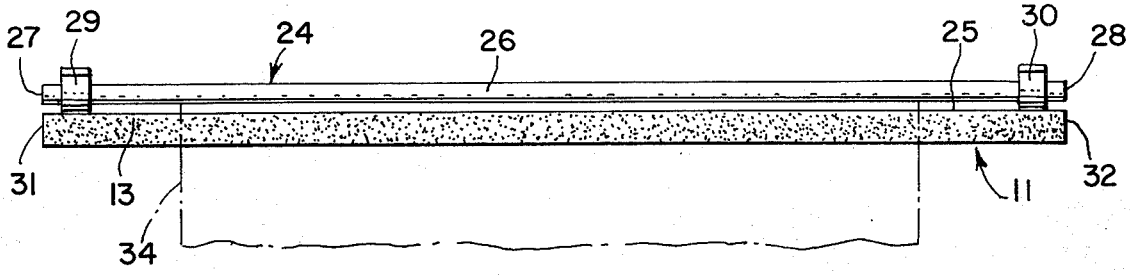
FIG. 5 shows a front section view of a retaining bar member detachably secured to the longitudinally extending portions of two wire hangers.

FIG. 5 shows a retaining bar member 24 detachably communicating with the upper surface 25 of the center portion 13 of the joining member 11. The bar member 24 comprises an elongated rod 26 having a pair of distal ends 27, 28, wherein the distal ends 27, 28 snap into clip members 29, 30 extending upward from the upper surface 25 of the center portion 13 at each end 31, 32 thereof. In use, the article of clothes 34 is positioned between the joining member 11 and the retaining member 24.

Since obvious changes may be made in the specific embodiment of the invention described herein, such modifications being within the spirit and scope of the invention claimed, it is indicated that all matter contained herein is intended as an illustrative and not as limiting in scope.

Having thus described the invention, what I claim as new and desire to secure by Letters Patent of the United States is:

1. A garment hanger, which comprises:

a. two wires each forming a closed configuration having a longitudinally extending lower portion, two inclined portions each having a lower end connected opposite ends of said lower portion, the upper ends of said inclined portions being secured together and bent to form a hook;

b. a tubular resilient member closed at one end thereof fitting over said hook ends;

c. an inverted elongated U-shaped member having a top center portion, a pair of downwardly extending legs and an interior surface of said center portion having a pair of parallel elongated groves therein, said lower portions inserted into said groves therein, said lower portions inserting into said groves; and d. flexible flange members affixed perpendicularly onto said legs, said flange members extending inwardly and overlapping each other.

2. A garment hanger according to claim 1, further comprises:

a. an elongated rod having a pair of distal ends; and b. a pair of clip members extending upwardly from said top center portion of said inverted elongated U-shaped member at each end thereof, said distal ends of said elongated rod detachably mounting into said clip members.

* * * * *